US006488087B2

(12) United States Patent
Longbottom et al.

(10) Patent No.: US 6,488,087 B2
(45) Date of Patent: Dec. 3, 2002

(54) FIELD DEVELOPMENT METHODS

(75) Inventors: James R. Longbottom, Magnolia, TX (US); Tommie A. Freeman, Flower Mound, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/805,611

(22) Filed: Mar. 13, 2001

(65) Prior Publication Data

US 2001/0045280 A1 Nov. 29, 2001

Related U.S. Application Data

(60) Provisional application No. 60/189,172, filed on Mar. 14, 2000.

(51) Int. Cl.[7] ..... E21B 43/17

(52) U.S. Cl. ..... 166/271; 166/50; 166/313

(58) Field of Search ..... 166/50, 52, 250.01, 166/250.15, 254.1, 313, 271, 281, 300; 175/41, 45, 61

(56) References Cited

U.S. PATENT DOCUMENTS 4,133,383 A * 1/1979 Ely ..... 166/270
5,025,859 A * 6/1991 Hanson et al. ..... 166/245
5,074,360 A 12/1991 Guinn
5,353,874 A * 10/1994 Manulik ..... 166/281
5,465,792 A * 11/1995 Dawson et al. ..... 166/294
5,520,247 A * 5/1996 Gmelig Meyling et al. 166/245

OTHER PUBLICATIONS

Colorado School of mines thesis "Horizontal Drilling in a Compartmentalized Oolitic Reservoir, San Andres formation, Olssufield, Texas" dated Jan. 4, 1999.

World Oil article "multi–lateral technique lowers drilling costs, Provides Environental benefits", pp. 41–47, dated Oct., 1999.

* cited by examiner

*Primary Examiner*—David Bagnell
*Assistant Examiner*—Brian Halford
(74) *Attorney, Agent, or Firm*—William M. Imwalle; Marlin R. Smith

(57) ABSTRACT

A field development system and associated methods provide a main wellbore intersecting a formation and having fractures extending outwardly from the main wellbore into the formation. Multiple additional wellbores, spaced apart from the main wellbore and without associated additional production facilities, intersect the fractures and provide auxiliary drainage of the formation into the main wellbore via the fractures extending outwardly therefrom.

26 Claims, 5 Drawing Sheets

FIELD DEVELOPMENT METHODS

CROSS-REFERENCE TO RELATED APPLICATION

The present application claims the benefit of the filing date of U.S. provisional application serial No. 60/189,172, filed Mar. 14, 2000.

BACKGROUND OF THE INVENTION

The present invention relates generally to production of, and injection into, subterranean wells and, in an embodiment described herein, more particularly provides a field development system and methods associated therewith.

To improve drainage of a formation, it has become quite common to drill one or more lateral wellbores extending outwardly from a parent wellbore and into the formation. An alternative is to drill numerous wellbores into the formation, but this generally requires additional production facilities for the additional wells. Such production facilities are very costly, so the choice is typically made to drill lateral wellbores where conditions warrant.

However, drilling lateral wellbores has its disadvantages as well. For example, a large amount of casing wear is usually experienced in drilling lateral wellbores. As another example, forming a pressure tight junction between the parent and lateral wellbores is a problem.

From the foregoing, it can be seen that it would be quite desirable to provide a field development system which enhances the drainage of a formation without requiring the drilling of lateral wellbores from a main producing wellbore, and without requiring numerous production facilities for numerous wellbores.

SUMMARY OF THE INVENTION

In carrying out the principles of the present invention, in accordance with an embodiment thereof, a field development system is provided in which a main producing wellbore is placed in fluid communication with one or more additional wellbores extending within a formation. Associated methods are also provided.

In broad terms, a method is provided which includes the steps of drilling a second wellbore to intersect a fracture extending outward from a first wellbore and flowing fluid between the first and second wellbores through the fracture. Both the first and second wellbores may intersect a formation into which the fracture extends, in which case the second wellbore effectively extends the drainage of the formation by the first wellbore, without the need of drilling a lateral wellbore from the first wellbore. Alternatively, the second wellbore may intersect a formation which is not intersected by the first wellbore, in which case the second wellbore provides a conduit by which the formation may be drained by the first wellbore.

The second wellbore may be equipped with a fluid property sensor, which may be in communication with a receiver in the first wellbore for transmission of fluid property indications to the surface. The sensor may be utilized to detect when water enters the second wellbore. Several of the second wellbores with sensors therein may be arranged in an array about the first wellbore, in which case an advancing sweep of water may be detected in two or more dimensions.

The advantages of the present invention may also be used in water flood or steam injection applications. For example, an injection well may be placed in fluid communication with additional wellbores drilled in a formation via fractures which extend outward from the injection well and intersect the additional wellbores.

In another aspect of the present invention, drainage wellbores which are drilled to intersect fractures extending outward from a main wellbore are plugged between the formation and the earth's surface. Thus, no additional production facilities are utilized to produce fluids from the drainage wellbores.

In yet another aspect of the present invention, the drainage wellbores may be drilled as lateral wellbores extending outward from a parent wellbore. The drainage wellbores may be drilled in more than one formation also intersected by the main production wellbore. Alternatively, the main production wellbore may not intersect one or more of the formations in which the drainage wellbores are drilled.

In still another aspect of the present invention, flow between a drainage wellbore and the main production wellbore may be prevented by releasing a flow blocking substance in the drainage wellbore. This may be useful, for example, to prevent water encroachment from the drainage wellbore to the main production wellbore. The flow blocking substance may be released by flowing a particular fluid, such as acid, from the main production wellbore into the drainage wellbore via a fracture.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
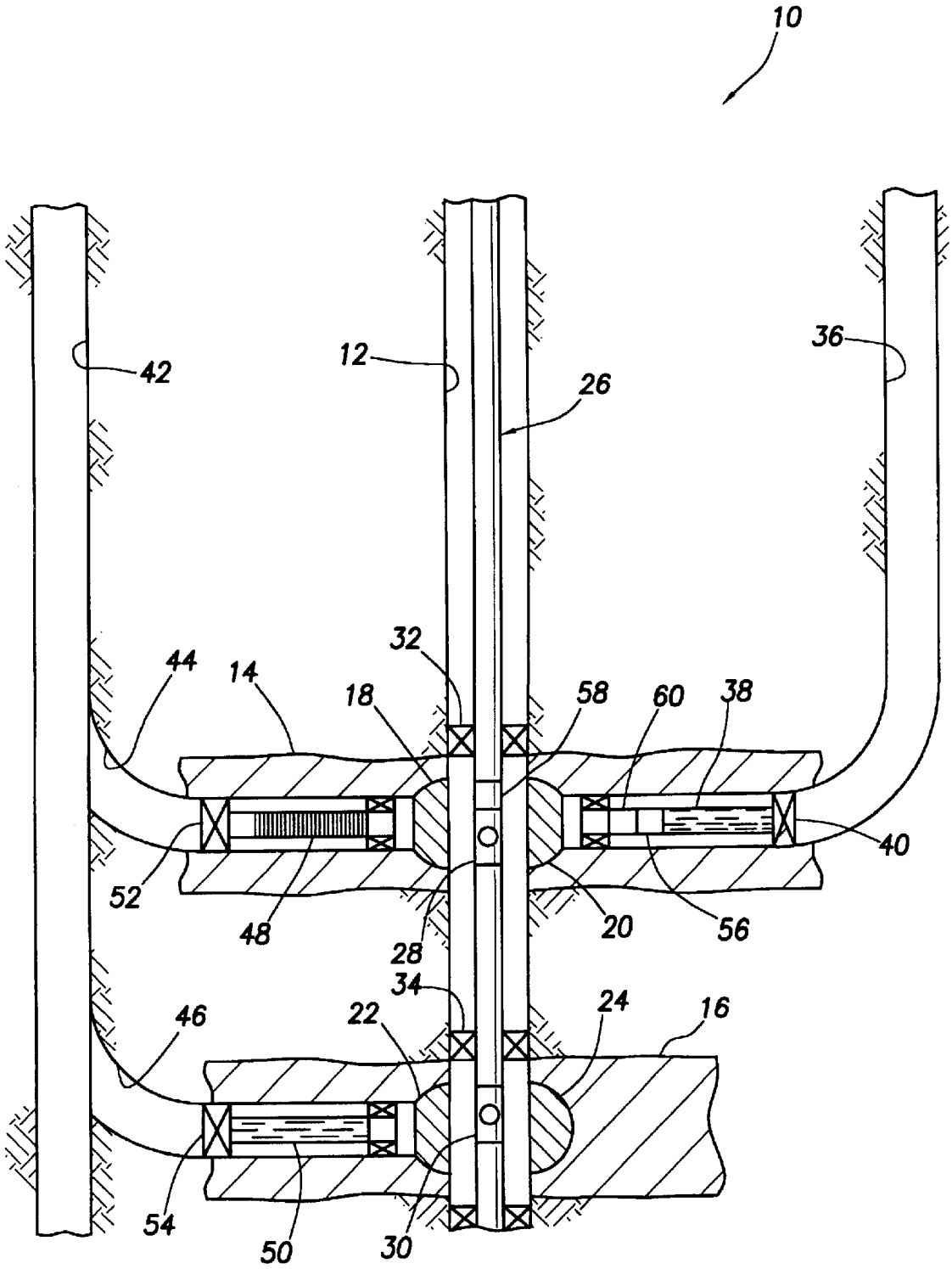
FIG. 1 is a schematic partially cross-sectional view of a first method and system embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In the method 10, a main production wellbore 12 is drilled so that it intersects one or more earth formations 14, 16 from which it is desired to produce fluids to the earth's surface. As used herein, the term "formation" is used to describe a formation or zone, or a portion thereof. Thus, the formations 14, 16 depicted in FIG. 1 may be different zones of a single formation, separate formations, etc. Of course, it is not necessary in the method 10 for the wellbore 12 to intersect more than one formation. Note that the wellbore 12 and other wellbores described herein may be cased or uncased, without departing from the principles of the present invention.

Fractures 18, 20 are formed extending outward from the wellbore 12 into the formation 14, and fractures 22, 24 are formed extending outward from the wellbore into the formation 16. A tubular string 26, which includes production valves 28, 30 and packers 32, 34, is installed in the wellbore 12 to control production from the formations 14, 16 and to provide a conduit for such production.

To enhance drainage of fluids from the formation 14, another wellbore 36 is drilled into the formation so that it intersects the fracture 20. Thus, fluids from the formation 14 can flow into the wellbore 36, which may extend hundreds or thousands of feet in the formation, and through the fracture 20 into the main wellbore 12. The wellbore 36 preferably intersects the fracture 20 at an acute angle, or an angle other than ninety degrees, to maximize the area of intersection between the wellbore 36 and the fracture 20.

A filtering device, such as a slotted liner 38, may be positioned within the wellbore 36 to filter the fluid flowing from the formation 14 into the wellbore. A plug 40 prevents flow of the fluids from the formation 14 upwardly through the wellbore 36 above the formation. Note that fluids produced from the formation 14 are flowed into the wellbore 36, but are produced through the main wellbore 12.

The wellbore 36 is shown as being a single wellbore drilled into the formation 14. However, FIG. 1 also depicts a method in which multiple wellbores may be drilled into multiple formations intersected by the main wellbore 12 and placed in fluid communication therewith. A parent wellbore 42 is drilled and then lateral or branch wellbores 44, 46 are drilled extending outward from the parent wellbore. The wellbore 44 is drilled into the formation 14 so that it intersects the fracture 18, and the wellbore 46 is drilled into the formation 16 so that it intersects the fracture 22. Preferably, the wellbores 44, 46 intersect the fractures 18, 22, respectively, at angles other than ninety degrees to enhance the area of intersection therebetween.

Fluid filtering devices, such as well screen 48 and slotted liner 50, may be used to filter the fluids flowing from the formations 14, 16 into the wellbores 44, 46, respectively. Plugs 52, 54 prevent upward flow of the fluids in the wellbores 44, 46, respectively, produced from the formations 14, 16.

A fluid property sensor 56, such as a pressure, temperature, resistivity, density, flow rate and/or other type of sensor, may be positioned in the wellbore 36 (and/or in any of the other drainage wellbores 44, 46). The sensor 56 may transmit fluid property indications to a receiver and/or transmitter 58 in the main wellbore 12. For example, the receiver 58 may receive and store the fluid property indications transmitted from the sensor/transmitter 56 for later retrieval by a conventional tool such as a wet connect conveyed on wireline or coiled tubing, or the receiver 58 may transmit the fluid property indications to the earth's surface or another remote location via electromagnetic waves, acoustic waves, pressure pulses, or other means. In this manner, an operator may be able to identify the specific fluids entering the wellbore 36 from the formation 14 and/or the rate at which the fluids are flowing.

Figure 2:
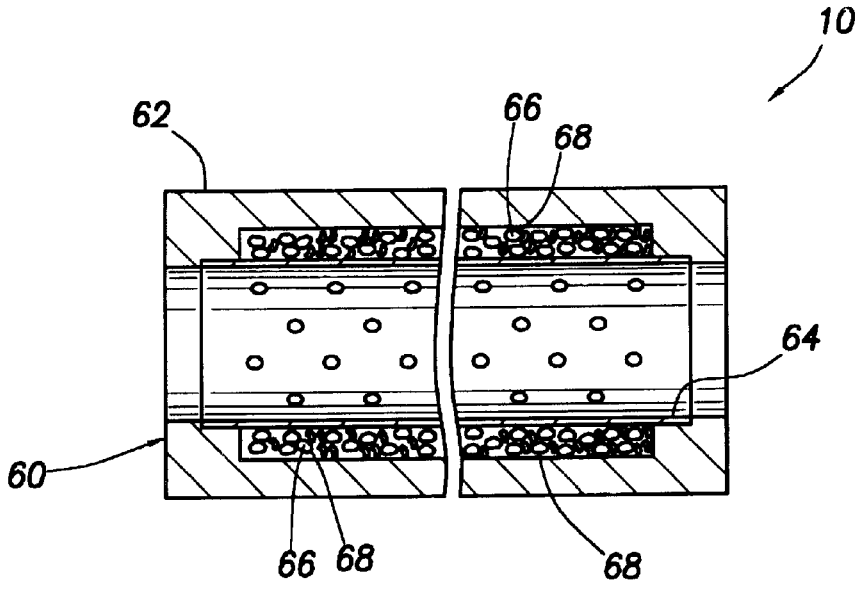
FIG. 2 is an enlarged scale cross-sectional view of a flow blocking apparatus usable in the first method and system of FIG. 1.

Eventually, it may be desired to prevent fluid flow between the wellbores 12, 36. For example, the wellbore 36 may begin producing water. To prevent fluid flow in the wellbore 36, a flow blocking apparatus 60 is positioned therein. The flow blocking apparatus 60 is shown representatively and schematically in an enlarged cross-sectional view in FIG. 2, but it is to be clearly understood that other types of flow blocking apparatus may be used in the method 10, without departing from the principles of the present invention.

The apparatus 60 includes a generally tubular outer housing 62 and a generally tubular perforated inner sleeve 64. A flow blocking substance 66, such as fines, coagulant, clay, resin, etc., in one or more capsules or other enclosures 68 is contained between the housing 62 and the sleeve 64. To release the flow blocking substance 66, a fluid which will weaken or dissolve the capsules 68 is flowed from the main wellbore 12 and into the wellbore 36 via the fracture 20. For example, the capsules 68 may be acid soluble and an acid may be flowed from the main wellbore 12, through the fracture 20, and into the wellbore 36 to dissolve the capsules 68 and release the flow blocking substance 66 therefrom.

If it is desired to block fluid from flowing from the wellbore 36 to the wellbore 12 via the fracture 20, such fluid flow may be used to convey the flow blocking substance 66 to the fracture, where it will plug the intersection between the wellbore 36 and the fracture and block subsequent flow therethrough. If it is desired to block fluid from flowing from the wellbore 36 to the formation 14, such fluid flow may be used to convey the flow blocking substance 66 to the wall of the formation 14 surrounding the wellbore 36. Note that the outer housing 62 of the apparatus 60 may be perforated in addition to, or as an alternative to, perforation of the inner sleeve 64.

Figure 3:
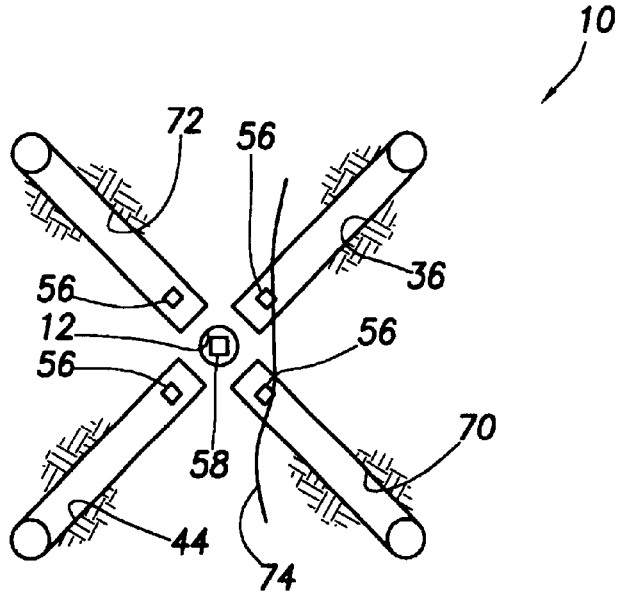
FIG. 3 is a top plan view of the first method and system of FIG. 1 showing an alternate configuration thereof.

Referring additionally now to FIG. 3, the method 10 is depicted schematically from a top view. Note that additional wellbores 70, 72 are shown as having been drilled into the formation 14 (not shown in FIG. 3), so that the wellbores 36, 44, 70, 72 are arrayed about the main wellbore 12. The wellbores 70, 72 also intersect fractures extending outward from the main wellbore 12, but these fractures and the fractures 18, 20 are not shown in FIG. 3 for illustrative clarity.

A sensor/transmitter 56 is positioned in each of the wellbores 36, 44, 70, 72 and is in communication with the receiver/transmitter 58 in the main wellbore 12. In this manner, the sensor/transmitters 56 form an array about the main wellbore 12 and may be used to present a two dimensional view of the properties of fluids flowing from the formation 14 via the wellbores 36, 44, 70, 72 into the main wellbore. For example, an encroaching "sweep" of water 74 may be indicated by sensors 56 in the wellbores 36, 70. It will be readily appreciated that a three dimensional view of the properties of fluids flowing from the formation 14 via the wellbores 36, 44, 70, 72 into the main wellbore 12 may be accomplished by positioning the sensor/transmitters 56 at different depths in the formation 14, such as by drilling the wellbores 36, 44, 70, 72 at different depths, or positioning the sensor/transmitters 56 at different depths in their respective wellbores.

Figure 4:
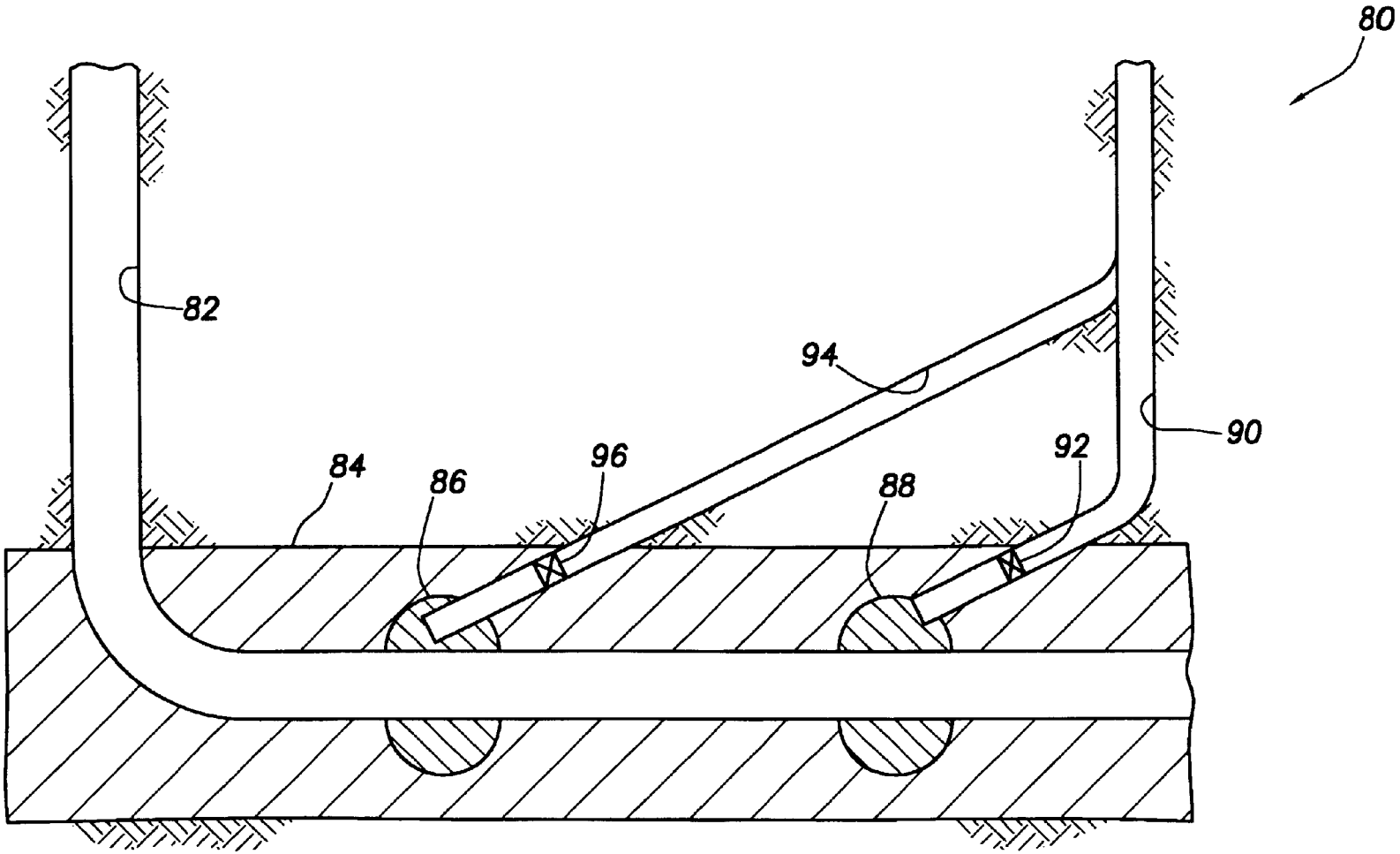
FIG. 4 is a schematic cross-sectional view of a second method and system embodying principles of the present invention.

Referring additionally now to FIG. 4, another method 80 embodying principles of the present invention is representatively and schematically illustrated. In the method 80, a main wellbore 82 is drilled into a formation 84. The wellbore 82 may extend generally horizontally in the formation 84 as depicted in FIG. 4, but such is not necessary in keeping with the principles of the present invention. Fractures 86, 88 are formed extending outward from the wellbore 82 into the formation 84. Alternatively, the fractures 86, 88 may be portions of a single fracture extending outward from the wellbore 82.

Another wellbore 90 is drilled into the formation 84 so that it intersects the fracture 88. Preferably, the wellbore 90 intersects the fracture at an angle other than ninety degrees. A plug 92 is installed in the wellbore 90 to prevent fluid flow from the formation 84 upwardly through the wellbore 90.

A branch or lateral wellbore 94 is drilled outward from the parent wellbore 90. The wellbore 94 is drilled into the formation 84 so that it intersects the fracture 86, preferably at an angle other than ninety degrees. A plug 96 is installed in the wellbore 94 to prevent fluid flow from the formation 84 upwardly through the wellbore 94.

Note that the wellbores 90, 94 are downwardly inclined in the formation 84 and are downwardly inclined at their intersections with the fractures 86, 88, respectively. This downward inclination is not necessary in keeping with the principles of the present invention, but it may provide gravity drainage of fluid from the wellbores 94, 90 to the wellbore 82. The wellbores 90, 94 may also have filtering devices, such as slotted liners, well screens, etc., installed therein to filter fluid flow from the formation 84 into the respective wellbores.

Figure 5:
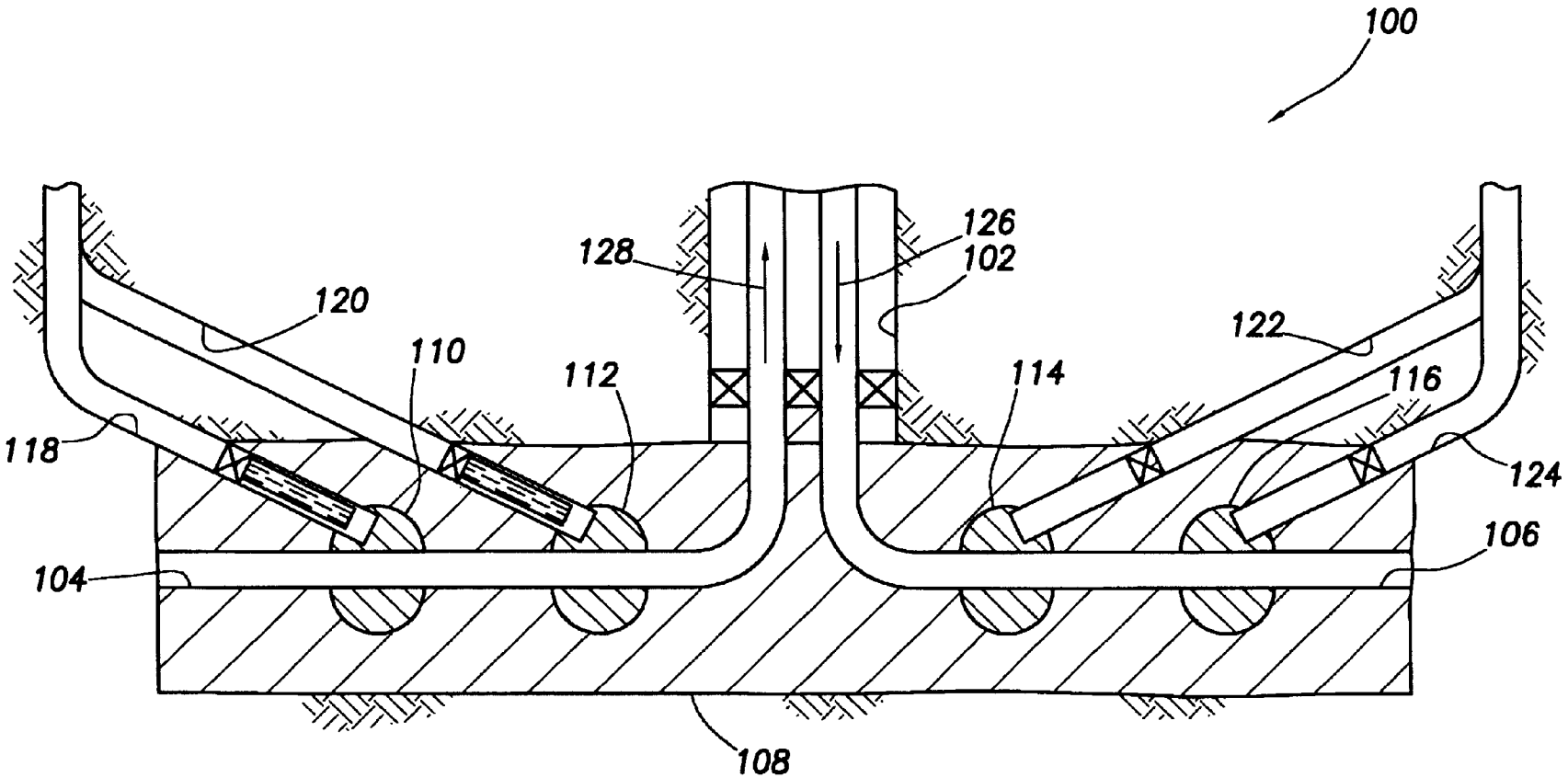
FIG. 5 is a schematic partially cross-sectional view of a third method and system embodying principles of the present invention.

Referring additionally now to FIG. 5, another method 100 embodying principles of the present invention is representatively and schematically illustrated. The method 100 is similar in many respects to the method 80 described above, but differs in at least one significant respect in that an injection operation is performed. A main wellbore 102 is drilled, and then a production wellbore 104 and an injection wellbore 106 are drilled extending outwardly from the main wellbore and into a formation 108. Of course, the wellbores 104, 106 could be branches of the main wellbore 102, the wellbore 106 could be a branch of the wellbore 104, or the wellbores could be drilled in any other manner, without departing from the principles of the present invention.

Fractures 110, 112 are formed extending outward from the wellbore 104 and fractures 114, 116 are formed extending outward from the wellbore 106. The fractures 110, 112, 114, 116 are intersected by wellbores 118, 120, 122, 124, respectively, drilled into the formation 108. It will be readily appreciated that a fluid (indicated in FIG. 5 by arrow 126), such as liquid water, steam, etc., may be injected into the formation 108 from the wellbore 106 via the fractures 114, 116 and the wellbores 122, 124. Fluid (indicated in FIG. 5 by arrow 128), such as hydrocarbons, etc., may in response be produced through the wellbore 104 from the wellbores 118, 120 and fractures 110, 112.

Figure 6:
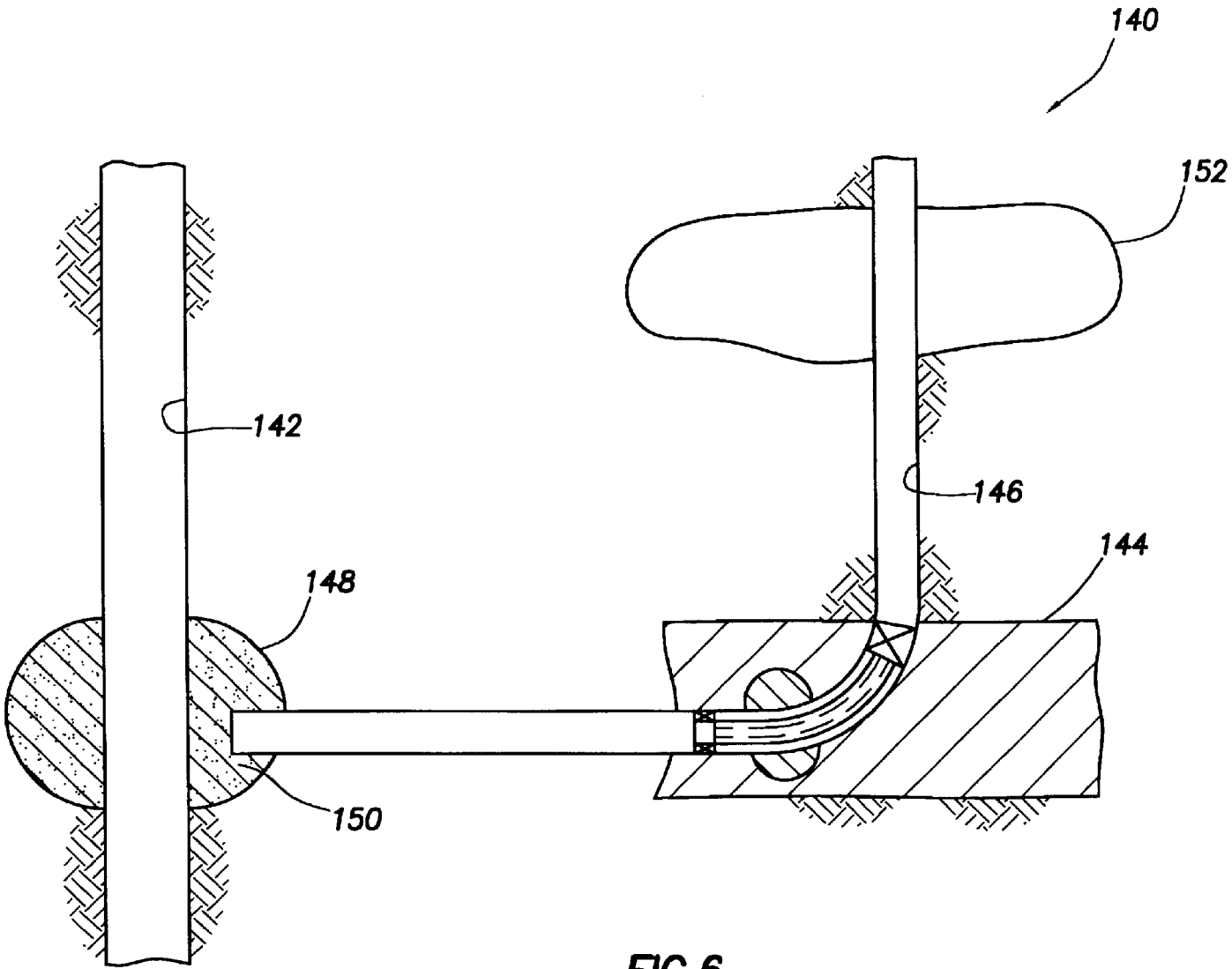
FIG. 6 is a schematic partially cross-sectional view of a fourth method and system embodying principles of the present invention.

Referring additionally now to FIG. 6, another method 140 embodying principles of the present invention is representatively and schematically illustrated. In the method 140, a production wellbore 142 is drilled, but it may not intersect a formation 144 from which it is desired to produce fluids. Instead, a second wellbore 146 is drilled into the formation 144 and then drilled to intersect a fracture 148 extending outward from the wellbore 142.

Preferably, the wellbore 146 intersects the fracture 148 at an angle other than ninety degrees, such as an acute angle. To aid in guiding the wellbore 146 to intersect the fracture 148, a radioactive source 150 may be deposited in the fracture. For example, the radioactive source 150 may be mixed with proppant and flowed into the fracture 148 when it is created in a fracturing operation in the wellbore 142. Thus, the wellbore 146 may be drilled toward the radioactive source 150, thereby guiding the wellbore to intersect the fracture 148.

It may now be fully appreciated that the method 140 provides a way to produce fluids from the formation 144 through the wellbore 142, even though the wellbore may not intersect the formation. This may be beneficial in situations where production via the wellbore 146 to the earth's surface is hazardous or uneconomical, such as when an area of subsidence 152 overlies the formation 144.

Note that, in the method 140, as well as any of the other methods described above, the formation 144 may also be fractured from the drainage wellbore 146 to improve fluid flow between the formation and the wellbore.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of communicating fluid between first and second wellbores, the method comprising the steps of:

forcing a radioactive source into a fracture extending outward from the first wellbore;

drilling the second wellbore to intersect the fracture by guiding the second wellbore toward the radioactive source; and flowing fluid between the first and second wellbores through the fracture.

2. The method according to claim 1, wherein the forcing step is performed during creation of the fracture.

3. The method according to claim 1, further comprising the step of positioning a fluid filtering device in the second wellbore, the filtering device filtering the fluid flowing between the first and second wellbores.

4. The method according to claim 3, wherein in the positioning step, the filtering device is a well screen.

5. The method according to claim 3, wherein in the positioning step, the filtering device is a slotted liner.

6. The method according to claim 1, further comprising the step of plugging the second well, and then performing the flowing step.

7. The method according to claim 1, further comprising the step of plugging the second well, and wherein the flowing step further comprises flowing fluid into the second wellbore from a formation intersected by the first wellbore and then into the first wellbore after the plugging step.

8. The method according to claim 1, further comprising the step of plugging the second well, and wherein the flowing step further comprises flowing fluid from the first wellbore into a formation intersected by the first wellbore and then into the second wellbore after the plugging step.

9. The method according to claim 1, wherein the drilling step further comprises drilling the second wellbore so that it intersects the fracture at an acute angle.

10. The method according to claim 1, wherein the drilling step further comprises drilling the second wellbore so that it intersects the fracture at an angle other than ninety degrees.

11. The method according to claim 1, wherein in the drilling step, the second wellbore is drilled as a branch wellbore extending outwardly from a parent wellbore.

12. The method according to claim 1, wherein the drilling step further comprises drilling multiple wellbores to intersect the fracture.

13. The method according to claim 1, further comprising the step of releasing a flow blocking substance in the second wellbore, thereby blocking fluid flow between the first and second wellbores.

14. The method according to claim 13, wherein the releasing step further comprises blocking fluid flow between the second wellbore and the fracture.

15. The method according to claim 13, wherein the releasing step further comprises blocking fluid flow between the second wellbore and a formation intersected by the first wellbore.

16. The method according to claim 13, wherein the releasing step is performed by flowing a preselected fluid from the first wellbore to the second wellbore, thereby releasing the flow blocking substance from within capsules in the second wellbore.

17. The method according to claim 1, wherein in the drilling step, the fracture is one of multiple fractures extending outward from the first wellbore, wherein the drilling step further comprises drilling a third wellbore to intersect another of the fractures, and further comprising the step of flowing fluid between the first and third wellbores through the other fracture.

18. The method according to claim 17, wherein in the drilling step, the second and third wellbores are branch wellbores extending outwardly from a parent wellbore.

19. The method according to claim 1, further comprising the steps of:

positioning a fluid property sensor in the second wellbore; and transmitting an indication of a fluid property sensed by the fluid property sensor from the second wellbore to the first wellbore.

20. The method according to claim 19, further comprising the step of transmitting the fluid property indication from the first wellbore to a remote location.

21. The method according to claim 19, wherein in the transmitting step, the fluid property indication specifies whether there is water in the second wellbore.

22. The method according to claim 1, wherein the drilling step further comprises drilling the second wellbore so that it is downwardly inclined in a formation intersected by the first wellbore and into which the fracture extends.

23. The method according to claim 22, wherein the drilling step further comprises drilling the second wellbore so that it is downwardly inclined at its intersection with the fracture.

24. The method according to claim 1, wherein the drilling step further comprises drilling the second wellbore so that it intersects a formation not intersected by the first wellbore, and wherein the flowing step further comprises flowing fluid from the formation into the second wellbore, and from the second wellbore into the first wellbore through the fracture.

25. The method according to claim 24, further comprising the step of forming a fracture extending outward from the second wellbore into the formation.

26. A method of controlling fluid flow between first and second nonintersecting wellbores, the method comprising the steps of:

flowing fluid from the second wellbore to the first wellbore via a fracture extending outward from the first wellbore; and then releasing a flow blocking substance in the second wellbore, thereby preventing fluid flow from the second wellbore to the first wellbore through the fracture.

* * * * *